US006039562A

United States Patent [19]

Li

[11] Patent Number: 6,039,562

[45] Date of Patent: Mar. 21, 2000

[54] PIEZOELECTRIC LIGHTER WITH SAFETY LOCK

[76] Inventor: Kin Chung Li, 2749 S. Cardillo Ave., Hacienda Heights, Calif. 91745

[21] Appl. No.: 09/332,300

[22] Filed: Jun. 11, 1999

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS 4,786,248 11/1988 Nitta ..... 431/153

5,971,751 10/1999 Lee ..... 431/153

*Primary Examiner*—Carroll Dority

*Attorney, Agent, or Firm*—Raymond Y. Chan; David & Raymond

[57] ABSTRACT

A piezoelectric lighter with safety lock, which can be a cigarette lighter or a barbecue lighter, includes a spring lock unit disposed inside a pusher cavity of a pusher cap, which includes a locking heel extended upwardly, a release button sidewardly extended from the locking heel through a locking hole provided on a side wall of a piezoelectric unit casing until a pressing end thereof normally exposed outside, and a spring member integrally extended from the locking heel to another side wall of the piezoelectric unit casing so as to urge the locking heel positioning in a locking condition to block the downward movement of the pusher cap so as to prevent any lighting operation of a piezoelectric unit received in a casing of the piezoelectric lighter. Only when the release button is pressed inwards to push the locking heel inwardly to an unlocking condition, where the locking heel is aligned with the unlocking groove of the pusher cap, the pusher cap is unlocked to be capable of pushing down simultaneously to press the moveable operating part of the piezoelectric unit to ignite the lighter.

18 Claims, 9 Drawing Sheets

PIEZOELECTRIC LIGHTER WITH SAFETY LOCK

FIELD OF THE PRESENT INVENTION

The present invention relates to gas lighter, and more particular to an automatic safety lock of a piezoelectric lighter, adapted to prevent the minor, especially under 5 years old, to ignite the lighter so as to guarantee the safety of children. The safety lock of the piezoelectric lighter can also prevent the lighter from being accidentally or unintentionally ignited by the adults.

BACKGROUND OF THE PRESENT INVENTION

For protecting the safety and benefit of children, the U.S. Consumer Product Safety Commission imposed an important regulation that "Child below 5 years old cannot light the lighter". Some of the piezoelectric lighters, such as U.S. Pat. Nos. 4,786,248, 4,859,172, 5,240,408, 5,368,473, and 5,462,432, each provides a switching mechanism for rendering the piezoelectric lighter child resistant. Each switching mechanism provides a switch member requiring the adult user to turn on before permitting an thumb-operated piezoelectric unit to be depressed to lift a gas pipe to open a gas release valve to emit gas and to generate sparks at the same time to ignite the emitted gas.

However, such conventional piezoelectric lighters with switching mechanism also bear the drawbacks as follows:

1. Some switching mechanisms require the piezoelectric lighter to alter its structure in order to equip with the switch member Or, numerous of additional elements of the switching mechanism are required to incorporate with the traditional piezoelectric lighter for ensuring the safety feature thereof Such costly switching mechanism not only increases the cost of the lighter, but also increases the manufacturing procedures of the lighter.

2. If the user forgets to turn off the switch member to its locking position, the piezoelectric lighter is already to ignite by any child. In other words, such switching-type safety piezoelectric lighter can provide safety function if and only if the adult user remembers to operate an additional turning off action to re-lock the switching mechanism of the piezoelectric lighter again. Most users may even intentionally skip this re-locking operation.

In fact, the conventional switching mechanism of the piezoelectric lighter is a manual lock only but can not be classified as a safety lock because a real safety lighter should normally be locked, that is the piezoelectric lighter should automatically re-lock after each ignition operation, so as to prevent the children from igniting the lighter anytime, or to prevent the lighter from accidentally or unintentionally be ignited by the user.

SUMMARY OF THE PRESENT INVENTION

A main object of the present invention is to provide a piezoelectric lighter equipped with a safety lock to normally lock up the piezoelectric unit to prevent the lighting operation of the piezoelectric lighter.

Another object of the present invention is to provide a piezoelectric lighter having a safety lock, which can automatically return to a locking condition after each ignition operation, so as to prevent any lighting operation of the piezoelectric unit by locking up the downward movement of the pusher cap.

Another object of the present invention is to provide a piezoelectric lighter with safety lock, which does not require to alter the original structural design of the piezoelectric lighter, so as to minimize the manufacturing cost of incorporating said safety lock with every conventional piezoelectric lighter having a pusher cap. Moreover, only one additional spring lock unit is required to provide the normally locked safety function, wherein this specifically designed spring lock unit can provide locking function and spring pressure at the same time.

Another object of the present invention is to provide a piezoelectric lighter, wherein the assemble of the safety lock as easy as simply by engaging the spring lock unit inside the middle casing. Therefore, the manufacturing cost and procedures of the present invention remain as usual and do not need to be increased as the conventional safety lighters did.

In order to accomplish the above objects, the present invention provides a piezoelectric lighter with safety lock, which can be a cigarette lighter or a barbecue lighter, comprising:

a casing having a liquefied gas storage and a piezoelectric unit casing affixing on top of the liquefied gas storage and defining a pusher cavity therein, wherein at least a locking hole, communicating the pusher cavity with outside, is provided on one side wall of the piezoelectric unit casing;

a gas ejection nozzle appearing from a ceiling of the casing and communicating with the liquefied gas storage for controlling the flow of gas;

a piezoelectric unit, which is fitted in the casing, having a movable operating part extended through the pusher cavity for generating piezoelectricity, and an ignition tip connected thereto;

a pusher cap slidably fitted in the pusher cavity of the casing in a vertically movable manner, exposing a top portion thereof above the casing and being attached to a top end of the piezoelectric unit, wherein an unlocking groove is provided on an inner side of a bottom portion of the pusher cap; and a spring lock unit, which is disposed inside the pusher cavity, comprising a locking heel extended upwardly, a release button sidewardly extended from the locking heel through the locking hole until a pressing end thereof normally exposed outside, and a spring member integrally extended from the locking heel to another side wall of the piezoelectric unit casing so as to urge the locking heel positioning in a locking condition to block the downward movement of the pusher cap so as to prevent any lighting operation of the piezoelectric unit, unless the release button is pressed inwards to push the locking heel inwardly to an unlocking condition where the locking heel is aligned with the unlocking groove of the pusher cap, so as to enable the pusher cap to be simultaneously push down to press the moveable operating part of the piezoelectric unit to ignite the lighter.

DETAILED DESCRIPTION OF THE PREFERRED EMBODIMENT

Figure 1:
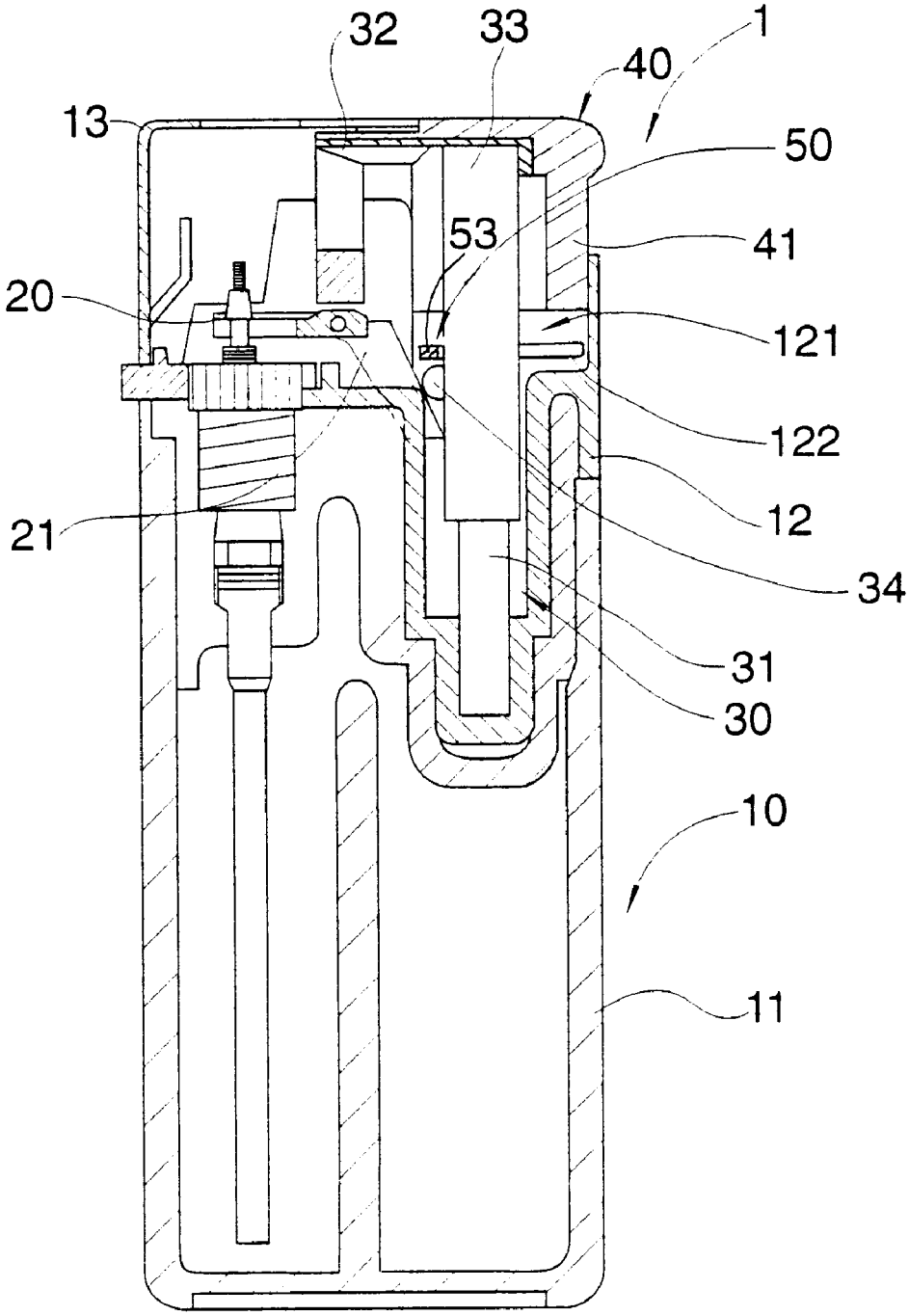
FIG. 1 is a sectional front view of a piezoelectric lighter with safety lock according to a preferred embodiment of the present invention.
Figure 2:
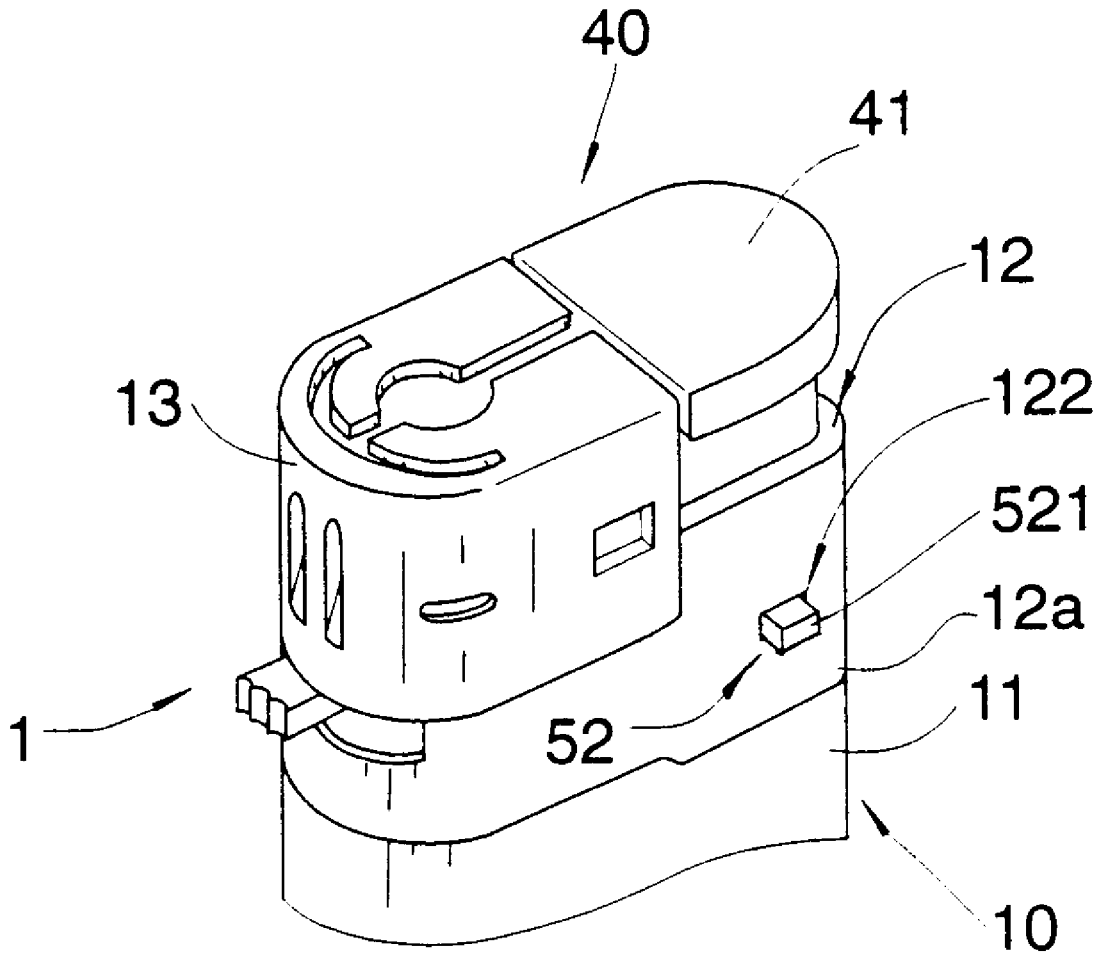
FIG. 2 is a partial perspective view of the piezoelectric lighter according to the above preferred embodiment of the present invention.

Referring to FIGS. 1 to 4 of the drawings, a piezoelectric lighter with safety lock according to a preferred embodiment of the present invention is illustrated. The piezoelectric lighter 1, such as a standard piezoelectric lighter, comprises a casing 10, a gas ejection nozzle 20, a piezoelectric unit 30, and a pusher cap 40. The casing 10 comprising a liquefied gas storage 11, and a piezoelectric unit casing 12 affixing on top of the liquefied gas storage 11 and defining a pusher cavity 121 therein.

As shown in FIG. 1, the gas ejection nozzle 20 appears from a ceiling of the casing 10 and communicating with the liquefied gas storage 11 for controlling the flow of gas. The piezoelectric lighter 1 further comprises a windshield 13 mounted on the ceiling of the casing 10 and encircling the gas ejection nozzle 20. The piezoelectric unit 30, which is fitted in the casing 10, has a movable operating part 31 extended through the pusher cavity 121 for generating piezoelectricity, and an ignition tip 32 connected thereto.

As shown in FIGS. 1, 2, 4A, and 4B, the pusher cap 40 is slidably fitted in the pusher cavity 121 of the piezoelectric unit casing 12 of the casing 10 in a vertically movable manner, exposing a top portion 41 thereof above the casing 10 and being attached to a top end 33 of the piezoelectric unit 30. The pusher cap 40 is operatively connected by a linkage both to the gas ejection nozzle 20 and to the piezoelectric unit 30 for striking spark in response to a push to the pusher cap 40.

Please reference to FIG. 1, for the conventional piezoelectric lighter without safety mechanism, a push-down action of the pusher cap 40 will downwardly drive and press the piezoelectric unit which will generate striking spark from the ignition tip 32 towards the gas ejection nozzle 20. Moreover, the downward movement of the piezoelectric unit will simultaneously operate to release gas by means of a die cast 34 attached on the movable operating part 31 of the piezoelectric unit 30 to downwardly press a gas lever 21 to function the gas ejection nozzle 20, so that the ejecting gas will be ignited by the striking spark ejected from the gas ejection nozzle 20.

According to the preferred embodiment of the present invention, merely simple modification is required to employed piezoelectric lighter 1 with a spring lock unit 50 so as to perform the safety lock function, including at least a locking hole 122, communicating the pusher cavity 121 with outside, provided on one side wall 12*a* of the piezoelectric unit casing 12, and at least an unlocking groove 401 provided between an inner side of a bottom portion 42 of the pusher cap 40 and the piezoelectric unit 30.

Figure 3:
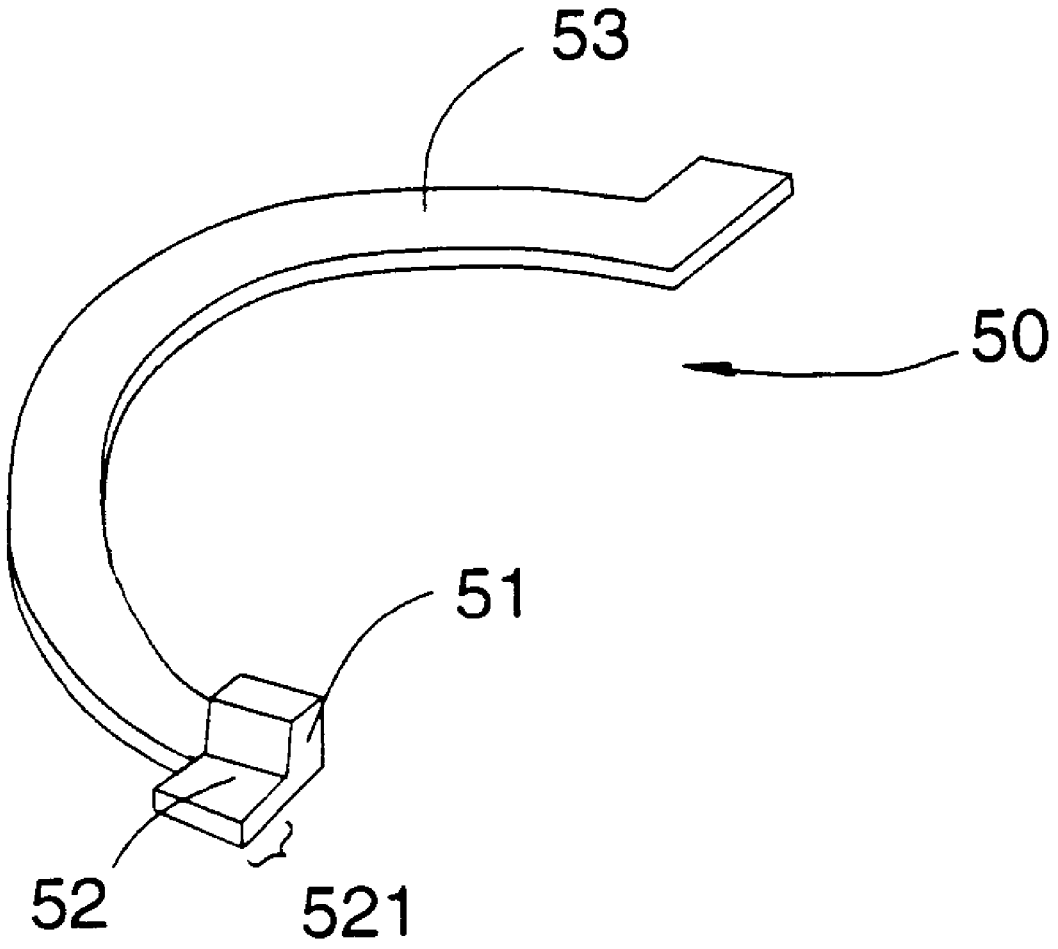
FIG. 3 is a perspective view of a spring lock unit of the piezoelectric lighter according to the above preferred embodiment of the present invention.
Figure 4A:
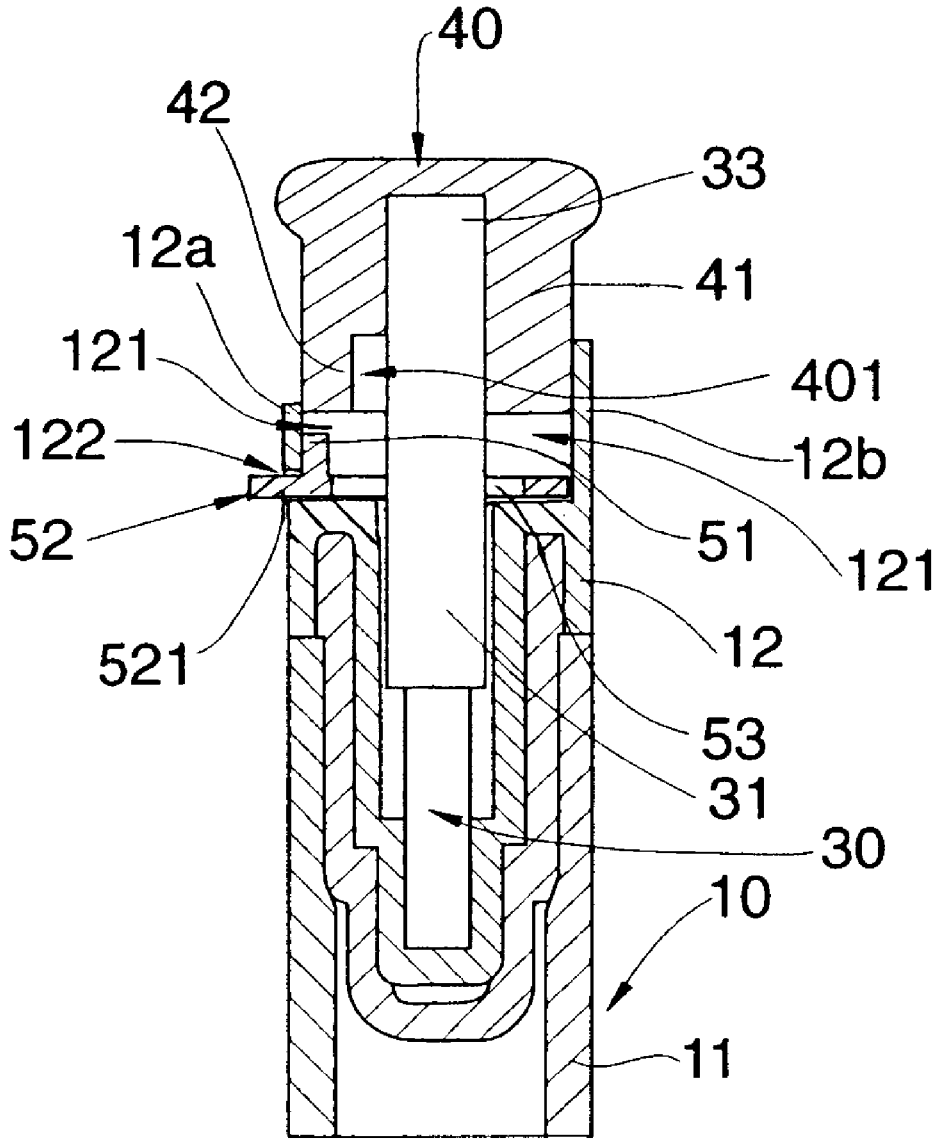
FIG. 4A is partial sectional end view of the piezoelectric lighter during a locking condition according to the above preferred embodiment of the present invention.

The spring lock unit 50 has a size fittingly disposed inside the pusher cavity 121. As shown in FIGS. 3 and 4A, the spring lock unit 50 comprises a locking heel 51 extended upwardly, a release button 52 sidewardly extended from the locking heel 51 through the locking hole 122 until a pressing end 521 thereof normally exposed outside, and a spring member 53 integrally extended from the locking heel 51 to another side wall 12*b* of the piezoelectric unit casing 12 so as to urge the locking heel 51 positioning in a locking condition, as shown in FIG. 4A, to block the downward movement of the pusher cap 40 so as to prevent any lighting operation of the piezoelectric unit 30.

According to the preferred embodiment of the present invention, the spring lock unit 50 is made of elastic material such as metal or plastic. The spring member 53 is in U-shaped or C-shaped adapted to extend around the movable operating part 31 of the piezoelectric unit 30 and between the two side walls 12*a* and 12*b*, wherein a spring pressure is provided to press the locking heel 51 urging against the first side wall 12*a*, adjacent to the locking hole 122, so as to maintain the locking heel 51 locating just underneath the bottom portion 42 of the pusher cap 40. Therefore, during such locking condition as shown in FIG. 4A, even the pusher cap 40 is pressed downward, the downward movement of the pusher cap 40 is blocked by the locking heel 51. That can prevent an adult from accidentally or unintentionally lighting the piezoelectric lighter 1 of the present invention.

Moreover, the release button 52 is preferred to have a length longer than a thickness of the locking hole 122 so that during the locking condition, the pressing end 521 of the release button 52 is protruded outside the piezoelectric unit casing 12, as shown in FIG. 4A. It is also worth to mention that the width of the unlocking groove 401 can be as wide as a width of the locking heel 51, or even can be a curved arc groove extended along the inner bottom surface of the pusher cap 40 to define a curved gap between the bottom portion 42 and the movable operating part 41 of the piezoelectric unit 40.

Figure 4B:
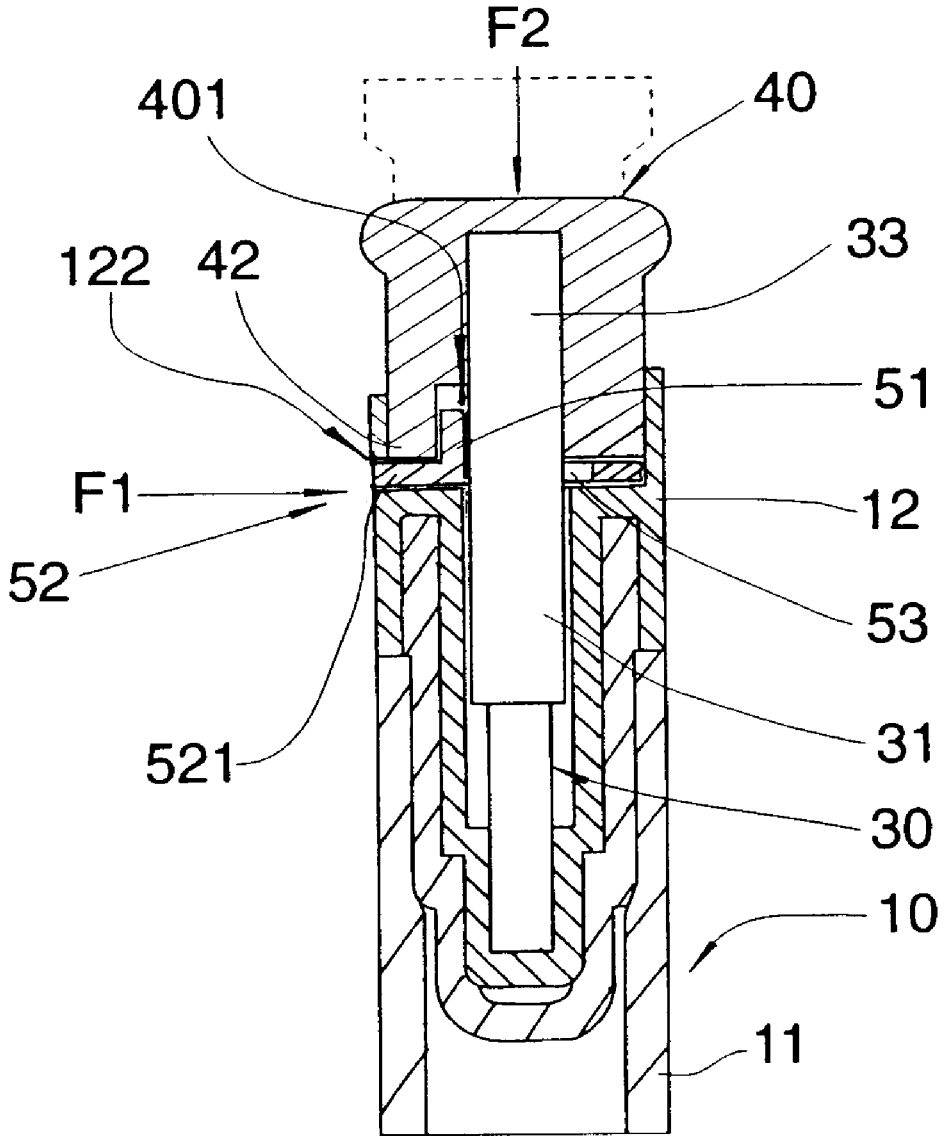
FIG. 4B is partial sectional end view of the piezoelectric lighter during an unlocking condition according to the above preferred embodiment of the present invention.

As shown in FIG. 4B, in order to ignite the piezoelectric lighter 1 of the present invention, merely press in the release button 52 is not enough. It is because once the pressing force applied on the release button 52 is released, the release button 5 and the locking heel 51 will be repressed to the original locking position. According to the present invention, a sideward force F1 and a downward force F2 must be applied simultaneously. When the sideward force F1 inwardly presses the release button 52, the locking heel 51 is pushed inwardly to the unlocking condition, where the locking heel 51 is aligned with the unlocking groove 401 of the pusher cap 40. At the same time, the downward force F2 pushes down the pusher cap 40 to simultaneously press down the moveable operating part 31 of the piezoelectric unit 30 to ignite the piezoelectric lighter 1.

In view of above, the piezoelectric lighter 1 of the present invention not only can successfully prevent children from lighting the piezoelectric lighter 1 by means of such dual unlocking actions, but also can automatically reset the locking heel 51 of the spring lock unit 50 to the locking position after each ignition of the piezoelectric lighter 1 by means of the integral spring member 53. In other words, the piezoelectric lighter 1 of the present invention is normally locked. Even after an ignition, no additional action has to take to re-lock the lighter. It will automatically re-lock again to provide better safety.

Figure 5:
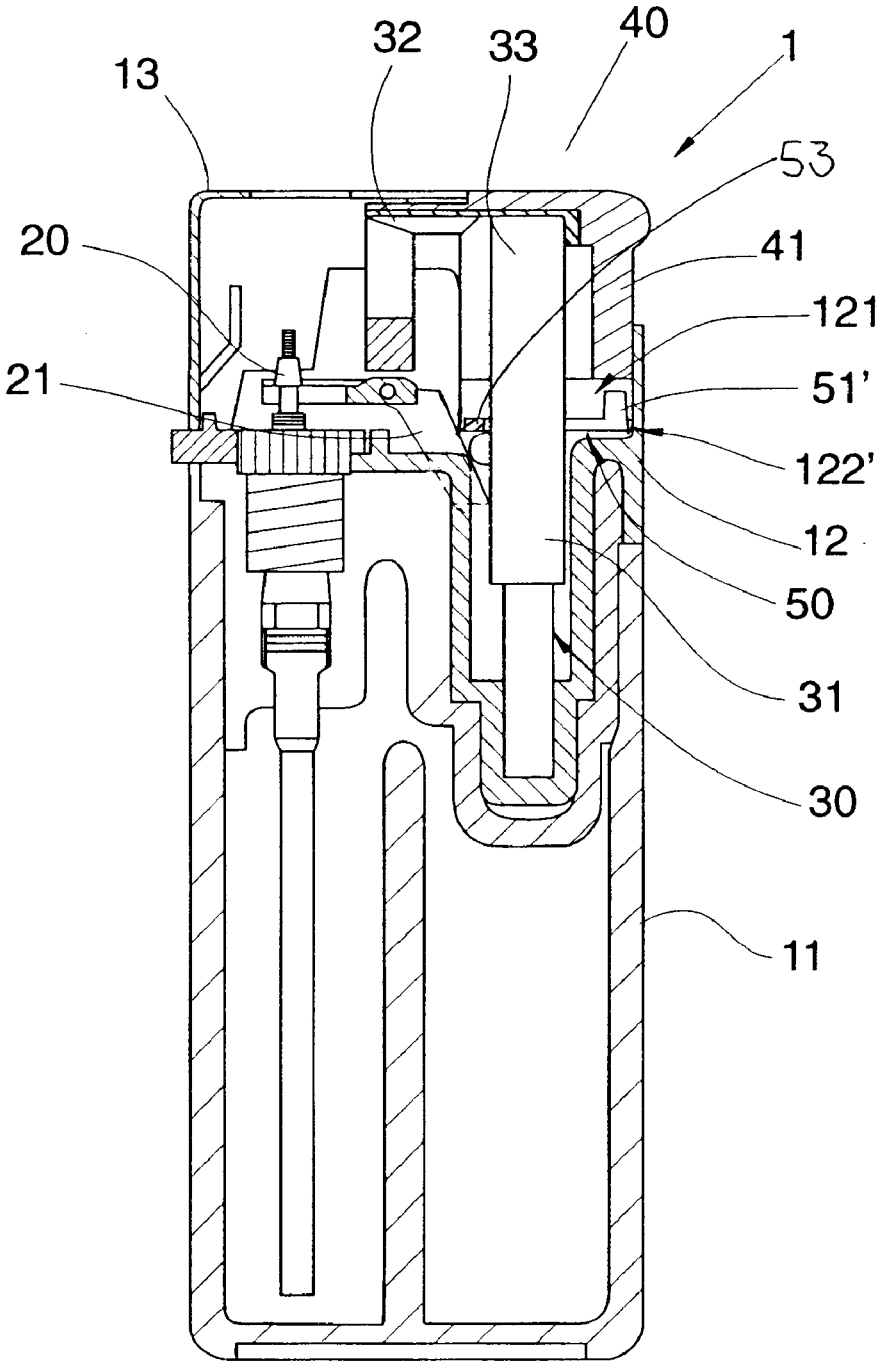
FIG. 5 is a sectional front view of a piezoelectric lighter with safety lock according to an alternative mode of the above preferred embodiment of the present invention.
Figure 6:
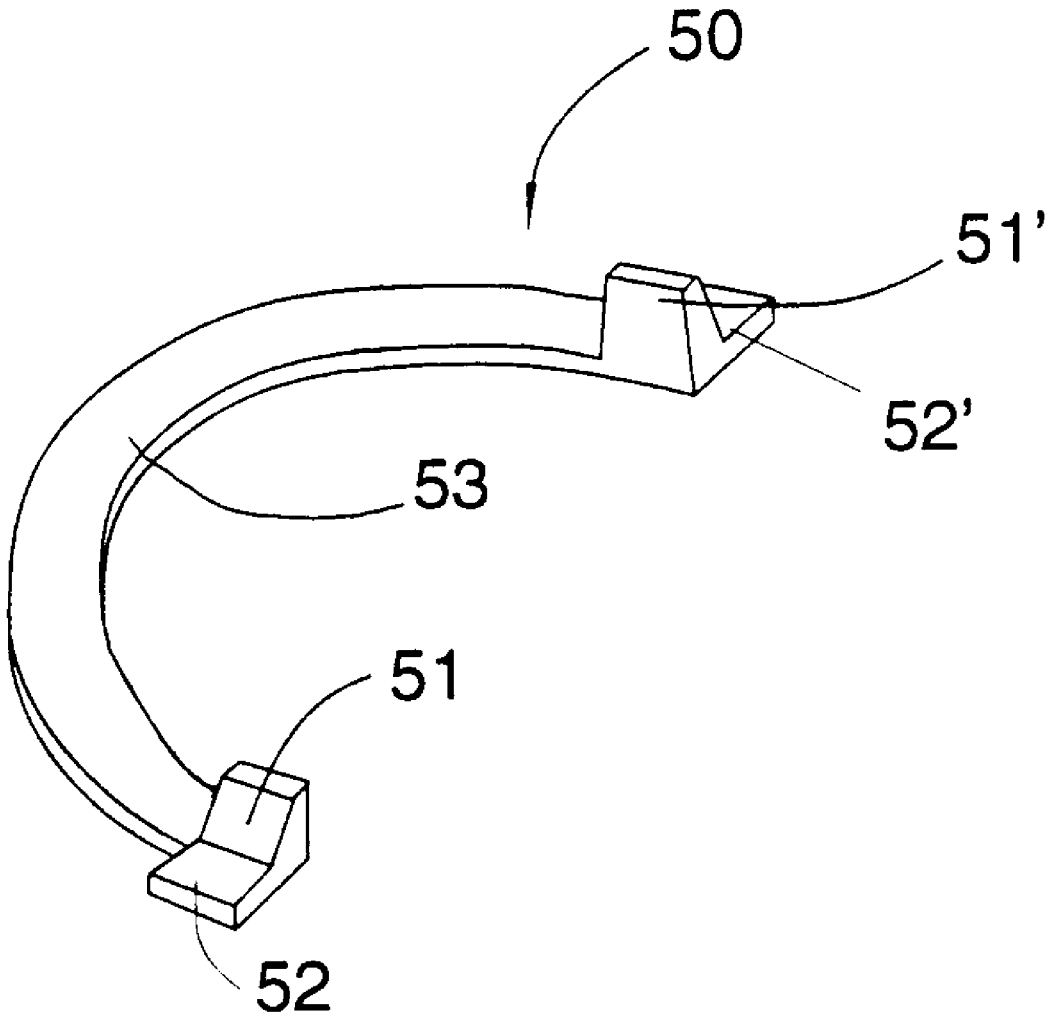
FIG. 6 is a perspective view of a spring lock unit of the piezoelectric lighter according to the alternative mode of the above preferred embodiment of the present invention.
Figure 7A:
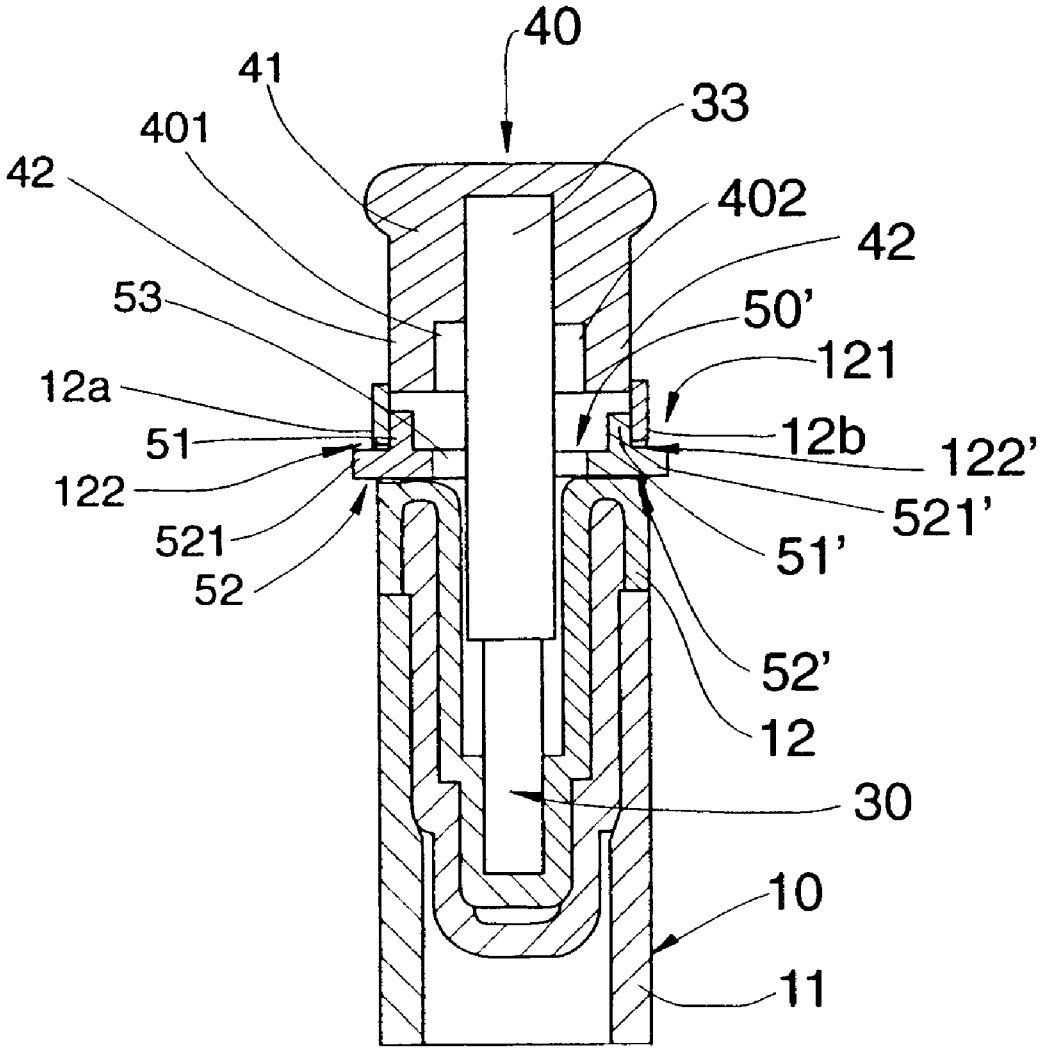
FIG. 7A is partial sectional end view of the piezoelectric lighter during a locking condition according to the alternative mode of the above preferred embodiment of the present invention.
Figure 7B:
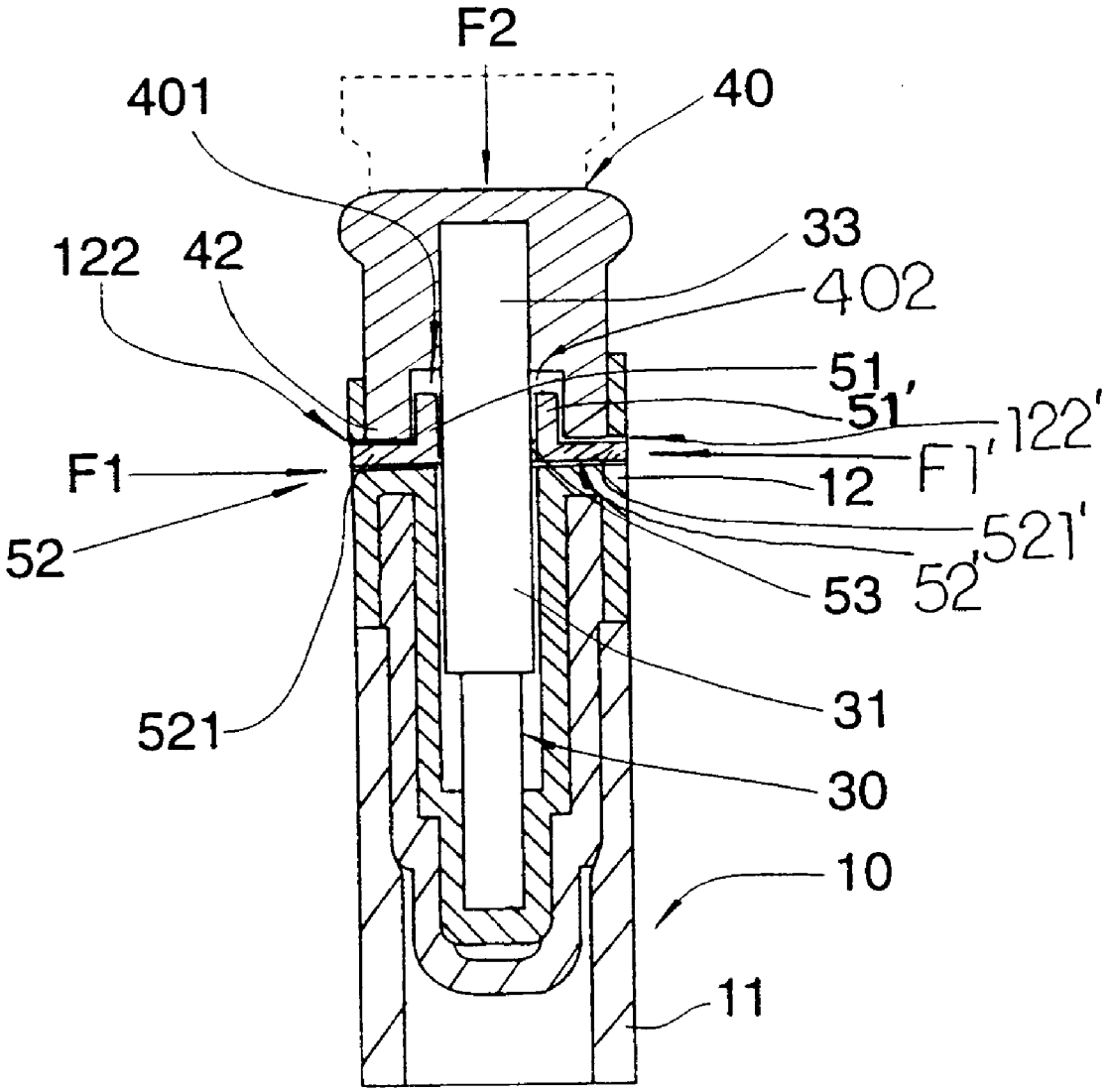
FIG. 7B is partial sectional end view of the piezoelectric lighter during an unlocking condition according to the alternative mode of the above preferred embodiment of the present invention.

Referring to FIGS. 5 to 7B, an alternative mode of the above preferred embodiment, wherein the piezoelectric lighter 1 is slightly modified but providing dual safety functions. As shown in FIG. 6, a modified spring lock unit 50' is employed, which comprises a pair of locking heels 51, 51' upwardly protruded from two ends of a U-shaped or C-shaped spring member 53, and a pair of release buttons 52, 52' sidewardly extended from the two locking heels 51, 51' respectively. As shown in FIGS. 5 and 7A, in order to install the alternative spring lock unit 50', the second side wall 12*b* of the piezoelectric unit casing 12 also provides a second locking hole 122' to enable a pressing end 521' of the second release button 52' to extended outside therethrough. If the unlocking groove 401 has a width merely equal to or slightly larger than the locking heel 51, a second unlocking groove 402 must be provided on another inner side of the bottom portion 42 of the pusher cap 40, as shown in FIGS. 7A and 7B. Certainly, a two unlocking grooves 401, 402 can extended towards each other to form a continuous C-shaped groove indented on the inner surface of the bottom portion 42, so as to define a curved gap between the bottom portion 42 and the movable operating part 41 of the piezoelectric unit 40.

According to the alternative mode disclosed in FIGS. 5 to 7A, normally, both sides of the bottom portion 42 of the push cap 40 are evenly and strongly blocked by the two locking heels 51, 51', i.e. the locking condition, as shown in FIG. 7A. As shown in FIG. 7B, in order to unlock the piezoelectric lighter 1, the user must simultaneously inwardly push both the two release buttons 52, 52' of the spring lock unit 50' and downwardly press the pusher cap 40, that increases the lighting difficulty for children for more security.

The safety lock introduced by the present invention not only can be employed with the cigarette-type piezoelectric lighter as shown in the drawings of the present invention, but also can be equipped with the barbecue type piezoelectric lighter that has the same structure, including the piezoelectric unit 30, piezoelectric unit casing 12 for receiving the piezoelectric unit 30 in a pusher cavity 121 thereof and a pusher cap 40 fitted inside the pusher cavity.

What is claimed is:

1. A piezoelectric lighter, comprising:

a casing having a liquefied gas storage and a piezoelectric unit casing affixing on top of said liquefied gas storage and defining a pusher cavity therein, wherein at least a locking hole, communicating said pusher cavity with outside, is provided on a first side wall of said piezoelectric unit casing;

a gas ejection nozzle appearing from a ceiling of said casing and communicating with said liquefied gas storage for controlling flow of gas;

a piezoelectric unit, which is fitted in said casing, having a movable operating part extended through said pusher cavity for generating piezoelectricity, and an ignition tip connected thereto;

a pusher cap slidably fitted in said pusher cavity of said casing in a vertically movable manner, exposing a top portion thereof above said casing and being attached to a top end of said piezoelectric unit, wherein an unlocking groove is between an inner side of a bottom portion of said pusher cap and said piezoelectric unit; and a spring lock unit, which is disposed inside said pusher cavity, comprising a locking heel extended upwardly, a release button sidewardly extended from said locking heel through said locking hole until a pressing end thereof exposed outside, and a spring member integrally extended from said locking heel to another side wall of said piezoelectric unit casing so as to urge said locking heel positioning in a locking condition to block said downward movement of said pusher cap so as to prevent any lighting operation of said piezoelectric unit, wherein to ignite said piezoelectric lighter, said release button is pressed inwards to push said locking heel inwardly to an unlocking condition where said locking heel is aligned with said unlocking groove of said pusher cap, so as to enable said pusher cap to be simultaneously push down to press said moveable operating part of said piezoelectric unit.

2. A piezoelectric lighter, as recited in claim 1, wherein said spring lock unit said spring lock unit is made of elastic material to form an integral body.

3. A piezoelectric lighter, as recited in claim 2, wherein said spring member is curvedly extended around said piezoelectric unit between said two side walls, wherein a spring pressure is provided to press said locking heel urging against said first side wall, adjacent to said locking hole, so as to maintain said locking heel locating just underneath said bottom portion of said pusher cap.

4. A piezoelectric lighter, as recited in claim 1, wherein said release button has a length longer than a thickness of said locking hole so that said pressing end of said release button is protruded outside said piezoelectric unit casing.

5. A piezoelectric lighter, as recited in claim 3, wherein said release button has a length longer than a thickness of said locking hole so that said pressing end of said release button is protruded outside said piezoelectric unit casing.

6. A piezoelectric lighter, as recited in claim 1, wherein said unlocking groove has a width for fittedly receiving said locking heel when said release button is pressed inwardly to said unlocking condition.

7. A piezoelectric lighter, as recited in claim 5, wherein said unlocking groove has a width fittedly for receiving said locking heel when said release button is pressed inwardly to said unlocking condition.

8. A piezoelectric lighter, as recited in claim 1, wherein said unlocking groove is a curved arc groove extended along said inner bottom portion of said pusher cap to define a curved gap between said bottom portion and said piezoelectric unit.

9. A piezoelectric lighter, as recited in claim 5, wherein said unlocking groove is a curved arc groove extended along said inner bottom portion of said pusher cap to define a curved gap between said bottom portion and said piezoelectric unit.

10. A piezoelectric lighter, as recited in claim 1, wherein a second side wall of said piezoelectric unit casing also provides a second locking hole thereon.

11. A piezoelectric lighter, as recited in claim 10, wherein a second unlocking groove is provided on another inner side of the bottom portion of the pusher cap.

12. A piezoelectric lighter, as recited in claim 10, wherein said unlocking groove is a curved arc groove extended along said inner bottom portion of said pusher cap to define a curved gap between said bottom portion and said piezoelectric unit.

13. A piezoelectric lighter, as recited in claim 11, wherein said spring member further comprises a second locking heel and a second release button sidewardly extended from said second locking heel, said spring member having two ends extended between said two locking heels, wherein said second a pressing end of said second release button is extended outside through said second locking hole on said second side wall of said piezoelectric unit casing.

14. A piezoelectric lighter, as recited in claim 13, wherein each of said release buttons has a length longer than a thickness of said respective locking hole.

15. A piezoelectric lighter, as recited in claim 13, wherein each of said unlocking grooves has a width fittedly for receiving said respective locking heel when said two release buttons are pressed inwardly to said unlocking condition.

16. A piezoelectric lighter, as recited in claim 14, wherein each of said unlocking grooves has a width fittedly for receiving said respective locking heel when said two release buttons are pressed inwardly to said unlocking condition.

17. A piezoelectric lighter, as recited in claim 12, wherein said spring member further comprises a second locking heel and a second release button sidewardly extended from said second locking heel, said spring member having two ends extended between said two locking heels, wherein said second a pressing end of said second release button is extended outside through said second locking hole on said second side wall of said piezoelectric unit casing.

18. A piezoelectric lighter, as recited in claim 17, wherein each of said release buttons has a length longer than a thickness of said respective locking hole.

* * * * *